US007540588B2

(12) United States Patent
Tang et al.

(10) Patent No.: US 7,540,588 B2
(45) Date of Patent: Jun. 2, 2009

(54) METHOD FOR PRINTING DATA AND INK JET PRINTER USING THE SAME

(75) Inventors: Chien-Hsing Tang, Taipei (TW); Sheng-Lung Tsai, Pingtung County (TW); Hao-Feng Hung, Taipei (TW); Chia-Te Wang, Taipei County (TW); Dao-Yueh Wu, Taipei County (TW)

(73) Assignee: Qisda Corporation, Taoyuan County (TW)

( * ) Notice: Subject to any disclaimer, the term of this patent is extended or adjusted under 35 U.S.C. 154(b) by 0 days.

(21) Appl. No.: 11/976,141

(22) Filed: Oct. 22, 2007

(65) Prior Publication Data

US 2008/0100651 A1 May 1, 2008

(30) Foreign Application Priority Data

Oct. 23, 2006 (TW) ..... 95139063 A

(51) Int. Cl.
*B41J 2/15* (2006.01)

(52) U.S. Cl. ..... 347/41; 347/15; 347/10

(58) Field of Classification Search ..... 347/9–12, 347/15, 41, 43

See application file for complete search history.

(56) References Cited

U.S. PATENT DOCUMENTS 6,533,393 B1 * 3/2003 Meyer et al. ..... 347/43

* cited by examiner

*Primary Examiner*—Lamson D Nguyen

(57) ABSTRACT

A method for printing data includes the following steps. First, an ink jet printer, having a print head with a black jet and a color jet, for printing a swath of data is provided. Then, the print head is driven to start to print the swath of data on one side of the ink jet printer. Next, the black jet and the color jet are alternately triggered to print corresponding pieces of black data and corresponding pieces of color data in the swath of data. Thereafter, the swath of data is completely printed when the print head is driven to the other side of ink jet printer.

11 Claims, 7 Drawing Sheets

METHOD FOR PRINTING DATA AND INK JET PRINTER USING THE SAME

This application claims the benefit of Taiwan application Serial No. 95139063, filed Oct. 23, 2006, the subject matter of which is incorporated herein by reference.

BACKGROUND OF THE INVENTION

1. Field of the Invention

The invention relates in general to a method for printing data and an ink jet printer using the same, and more particularly to a method for printing data and an ink jet printer using the same to increase the speed of printing the data.

2. Description of the Related Art

With the progress of the technology, a printer has gradually become an important image output apparatus in the daily life of the modern human beings. The low price and the excellent printing quality of the ink jet printer have made the ink jet printer become the most popularized computer image output apparatus.

FIG. 1 (Prior Art) is a block diagram showing a conventional ink jet printer 100. The ink jet printer 100 includes a paper feeding device 102, a printing system controller 104, a carrier 106, a phase encoder 108, an ink jet driving circuit 110 and a print head 112. The paper feeding device 102 moves the sheet. The print head 112 is substantially disposed on the carrier 106. When the carrier 106 is moved, the phase encoder 108 generates corresponding phase signals A and B to record the position of the carrier 106.

The printing system controller 104 receives to-be-printed data from an external host 114, and outputs the to-be-printed data corresponding to a predetermined position to the print head 112 when the carrier 106 is moved to the predetermined position. FIG. 2 (Prior Art) shows waveforms of phase signals generated by the phase encoder 108 of FIG. 1. As shown in FIG. 2, when the carrier 106 is moved to the predetermined positions N, N+1, N+2 . . . , in which the phase signal A or B changes, the printing system controller 104 outputs the corresponding data to be printed.

FIG. 3 (Prior Art) is a circuit diagram showing the ink jet driving circuit 110 and the print head 112 of FIG. 1. Referring to FIG. 3, the ink jet driving circuit 110 includes a power supply 1102, a control logic block 1104, a P-line driver 1106 and an A-line driver 1108. The power supply 1102 provides operation voltages for the P-line driver 1106 and the A-line driver 1108. The control logic block 1104 outputs multiple control signals PLOAD and PENABLE, a clock signal PCLK, a black data signal PDATAB and a color data signal PDATAC to the P-line driver 1106, and the control logic block 1104 outputs a control signal AENABLE to the A-line driver 1108.

The print head 112 includes a black jet 1121 and a color jet 1122 each having multiple heaters. The control logic block 1104 outputs a first enable signal P_select_B to control the black jet 1121 and outputs a second enable signal P_select_C to control the color jet 1122. Multiple P signals P1 to Pn outputted from the P-line driver 1106 and multiple A signals A1 to Am outputted from the A-line driver 1108 respectively control the heaters to jet an ink drop to print the data.

FIG. 4 (Prior Art) shows timings for the ink jet driving circuit 110 and the print head 112 in FIG. 3. As shown in FIG. 4, the control signal AENABLE controls the A signals, the control signal PENABLE controls the P signals, and the black data signal PDATAB and the color data signal PDATAC respectively transfer black data and color data corresponding to the to-be-printed data. The clock signal PCLK sequentially inputs the data to the shift register (not shown) of the ink jet driving circuit 110, and the control signal PLOAD loads the data to an output terminal of the ink jet driving circuit 110 to wait for the control signal PENABLE to enable the P signals. In addition, the first enable signal P_select_B and the second enable signal P_select_C respectively control whether the P signals in the black jet 1121 and the color jet 1122 are enabled.

The signals outputted from the ink jet driving circuit 110 to the print head 112 include the signals A1 to Am, and can control m×n×2 heaters in total. The signals "A" are enabled in the order from A1 to Am, while the P signals can be enabled or disabled simultaneously. This means that when the first enable signal P_select_B enables the P signals of the black jet 1121, n heaters controlled by the signal A1 in the black jet 1121 simultaneously receive the energy to jet the ink drop first, then n heaters controlled by the signal A2 receive the energy to jet the ink drop, and finally n heaters controlled by the signal Am receive the energy to jet the ink drop. When the second enable signal P_select_C enables the P signals of the color jet 1122, n heaters controlled by the signal A1 in the color jet 1122 simultaneously receive the energy to jet the ink drop first, then n heaters controlled by the signal A2 receive the energy to jet the ink drop, and finally n heaters controlled by the signal Am receive the energy to jet the ink drop.

According to the conventional method for printing the data and the ink jet printer using the same, when the print head 112 is located at a predetermined position N, the black data, which is transferred by the data signal PDATAB and corresponds to the predetermined position N, is usually printed first, and then the color data, which is transferred by the data signal PDATAC and corresponds to the predetermined position N+1, is printed. The printing operations are repeated in a similar manner until a swath of data is completely printed. Then, the next swath of data can be printed. As shown in FIG. 4, however, a rear half of the time in which the print head 112 is moved from the predetermined position N to the predetermined position N+1, is not utilized so that the time resource is wasted and the data printing speed cannot be optimized.

SUMMARY OF THE INVENTION

The invention is directed to a method for printing data and an ink jet printer using the same. The order of timings for driving a black jet and a color jet of the ink jet printer is controlled when a swath of data is being printed so that black data and color data may be respectively printed at a predetermined position and the speed of printing the data may be increased.

According to a first aspect of the present invention, a method for printing data is provided. The method includes the following steps. First, an ink jet printer is provided to print a swath of data. The ink jet printer has a print head. The print head has a black jet and a color jet. Next, the print head is driven to start to print the swath of data on one side of the ink jet printer. Then, the black jet and the color jet are alternately triggered to print corresponding pieces of black data and corresponding pieces of color data in the swath of data. When the print head is driven to the other side of the ink jet printer, the swath of data is completely printed.

According to a second aspect of the present invention, an ink jet printer is provided. The ink jet printer prints a swath of data including pieces of black data and pieces of color data. The ink jet printer includes a print head, a phase encoder and an ink jet driving circuit. The print head has a black jet and a color jet. The phase encoder records a plurality of predetermined positions each corresponding to one of the pieces of black data and one of the pieces of color data. The ink jet driving circuit outputs a first enable signal and a second enable signal. The black jet prints the corresponding piece of black data in the swath of data when the first enable signal is enabled. The color jet prints the corresponding piece of color data in the swath of data when the second enable signal is enabled. The first enable signal and the second enable signal are alternately enabled. When the first enable signal and the second enable signal are enabled once, the piece of black data and the piece of color data corresponding to the predetermined position, at which the print head is located, are completely printed.

The invention will become apparent from the following detailed description of the preferred but non-limiting embodiment. The following description is made with reference to the accompanying drawings.

DETAILED DESCRIPTION OF THE INVENTION

The invention provides a method for printing data and an ink jet printer using the same. The order of timings for driving a black jet and a color jet of the ink jet printer is controlled when a swath of data is being printed so that black data and color data may be respectively printed at a predetermined position and the speed of printing the data may be increased.

Figure 1:
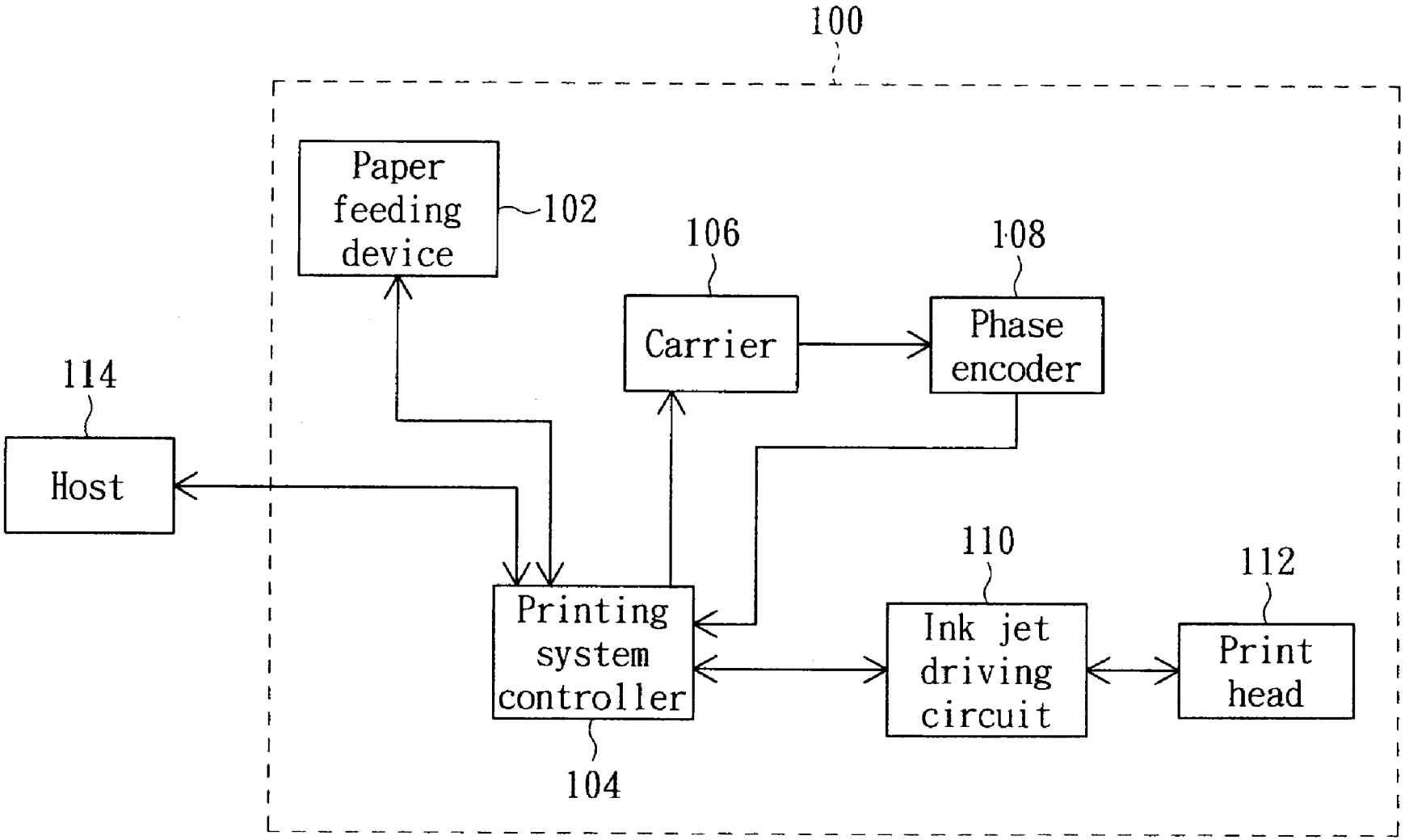
FIG. 1(PRIOR ART)
FIG. 1 (Prior Art) is a block diagram showing a conventional ink jet printer.
Figure 2:
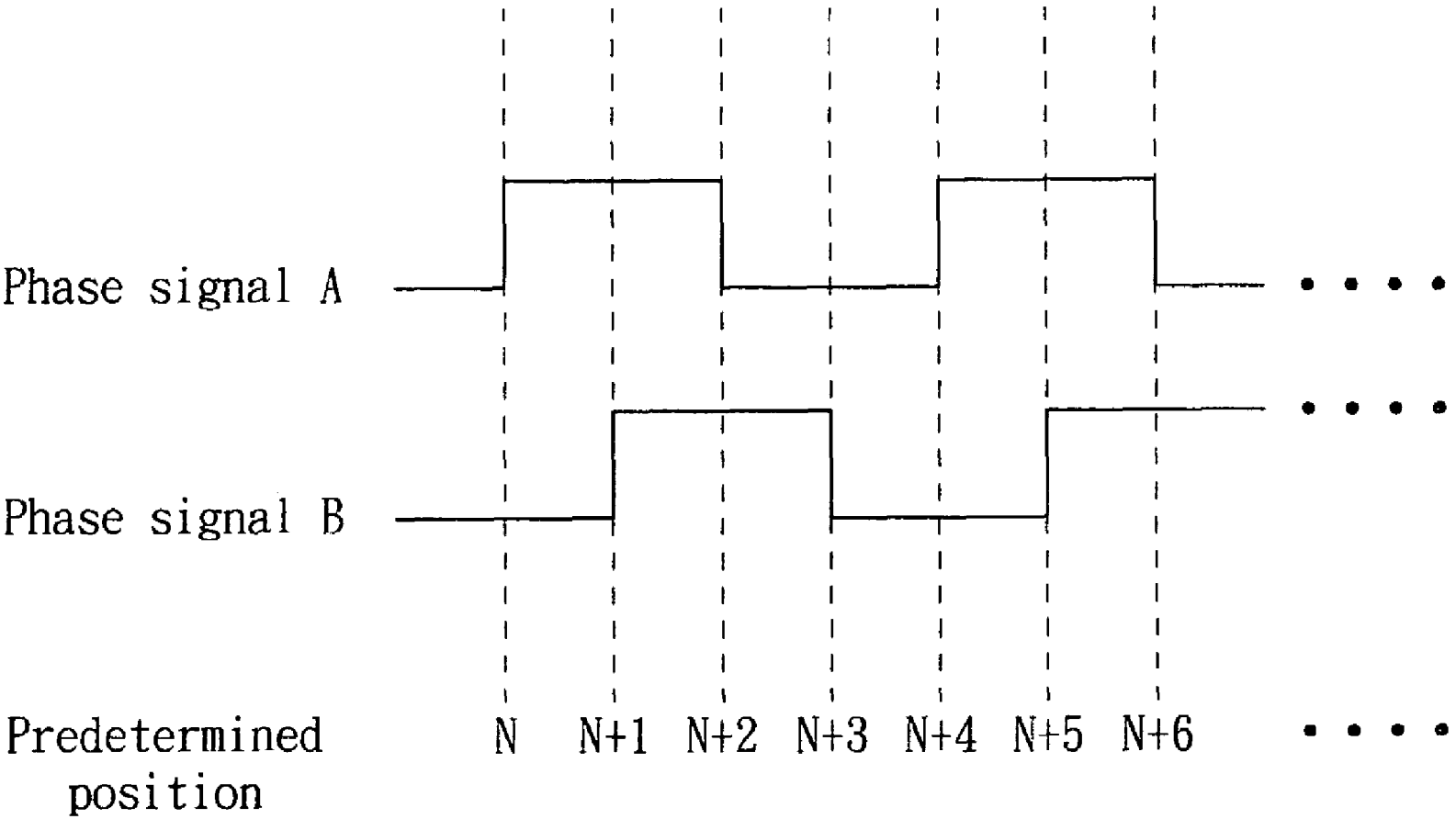
FIG. 2(PRIOR ART)
FIG. 2 (Prior Art) shows waveforms of phase signals generated by a phase encoder 108 of FIG. 1.

As shown in FIG. 1, the ink jet printer 100 is for printing a swath of data, which is transmitted from the host 114 to the ink jet printer 100 and includes pieces of black data and pieces of color data. The color data is composed of cyan data, magenta data and yellow data. The ink jet printer 100 includes the print head 112, the phase encoder 108 and the ink jet driving circuit 110. The print head 112 has a black jet and a color jet (not shown in FIG. 1). The phase encoder 108 records multiple predetermined positions each corresponding to one of the pieces of black data and one of the pieces of color data. The phase encoder 108 generates a corresponding phase signal A and a corresponding phase signal B to record the predetermined positions of the carrier 106. The phase signal B is formed by delaying the phase signal A by 90 degrees.

Figure 3:
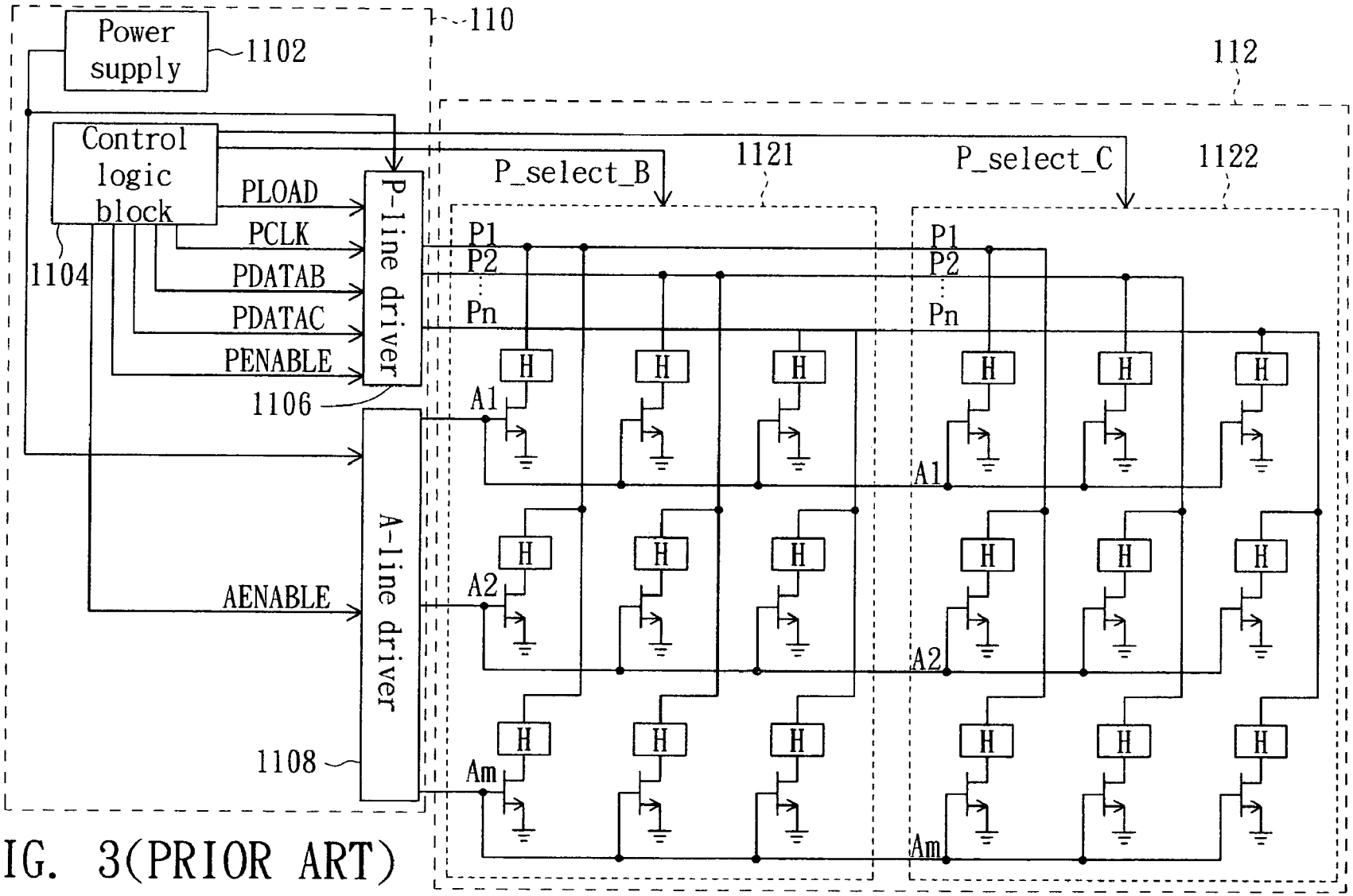
FIG. 3(PRIOR ART)
FIG. 3 (Prior Art) is a circuit diagram showing an ink jet driving circuit 110 and a print head 112 of FIG. 1.
Figure 4:
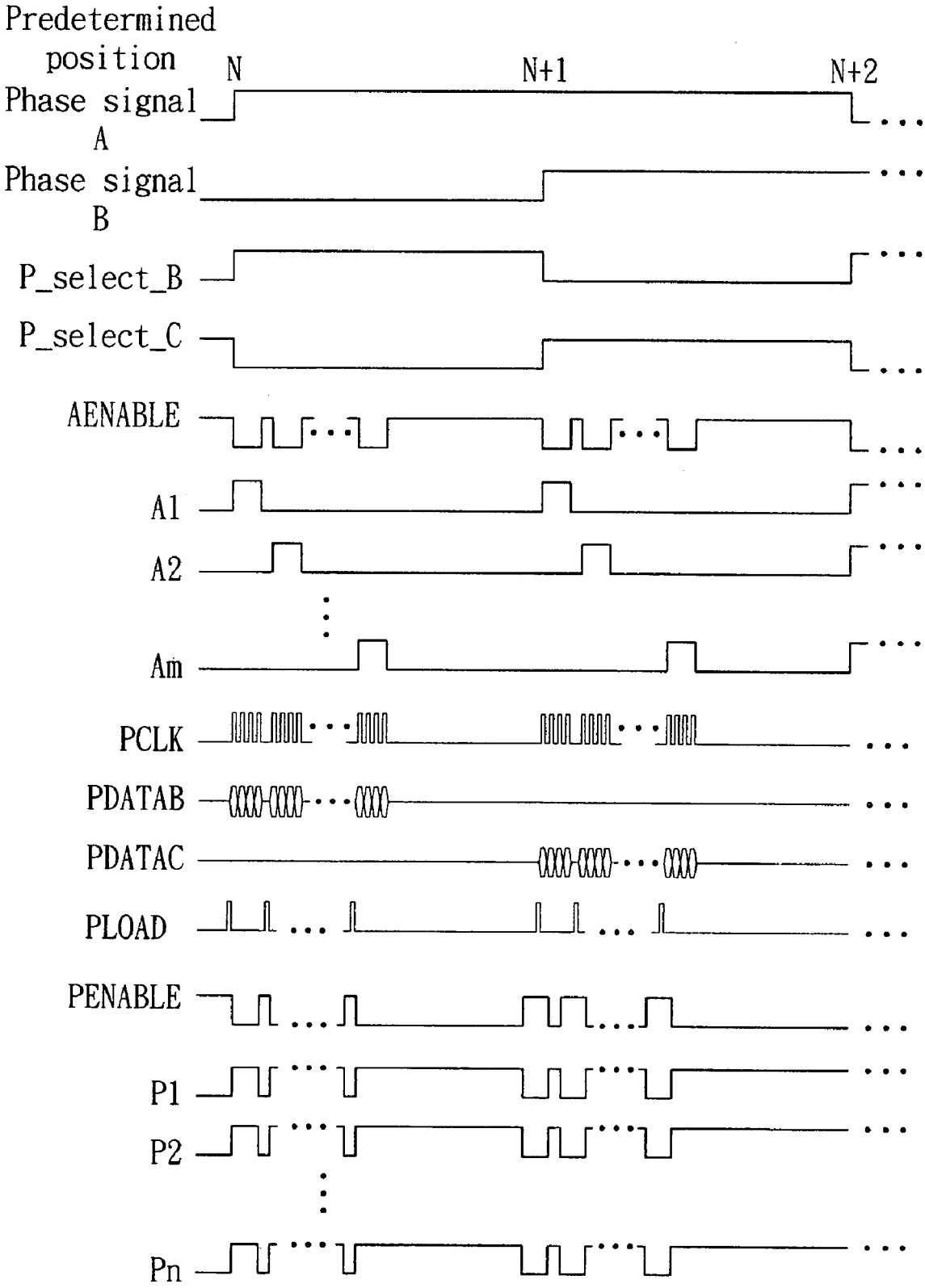
FIG. 4(PRIOR ART)
FIG. 4 (Prior Art) shows timings for the ink jet driving circuit 110 and the print head 112 in FIG. 3.

The circuit diagram of the ink jet driving circuit 110 is shown in FIG. 3. The ink jet driving circuit 110 outputs a first enable signal P_select_B and a second enable signal P_select_C. When the first enable signal P_select_B is enabled, the black jet 1121 prints the corresponding black data in the swath of data. When the second enable signal P_select_C is enabled, the color jet 1122 prints the corresponding color data in the swath of data. The first enable signal P_select_B and the second enable signal P_select_C are alternately enabled. After the first enable signal P_select_B and the second enable signal P_select_C are enabled once, the black data and the color data corresponding to the predetermined position, at which the print head 112 is located, have been completely printed.

After the black data and the color data corresponding to the predetermined position, at which the print head 112 is located, have been completely printed, the print head 112 is moved to a next predetermined position to prepare to print the black data and the color data corresponding to the next predetermined position. After the swath of data is completely printed, the paper feeding device 102 moves the sheet to prepare to print the next swath of data.

Figure 5:
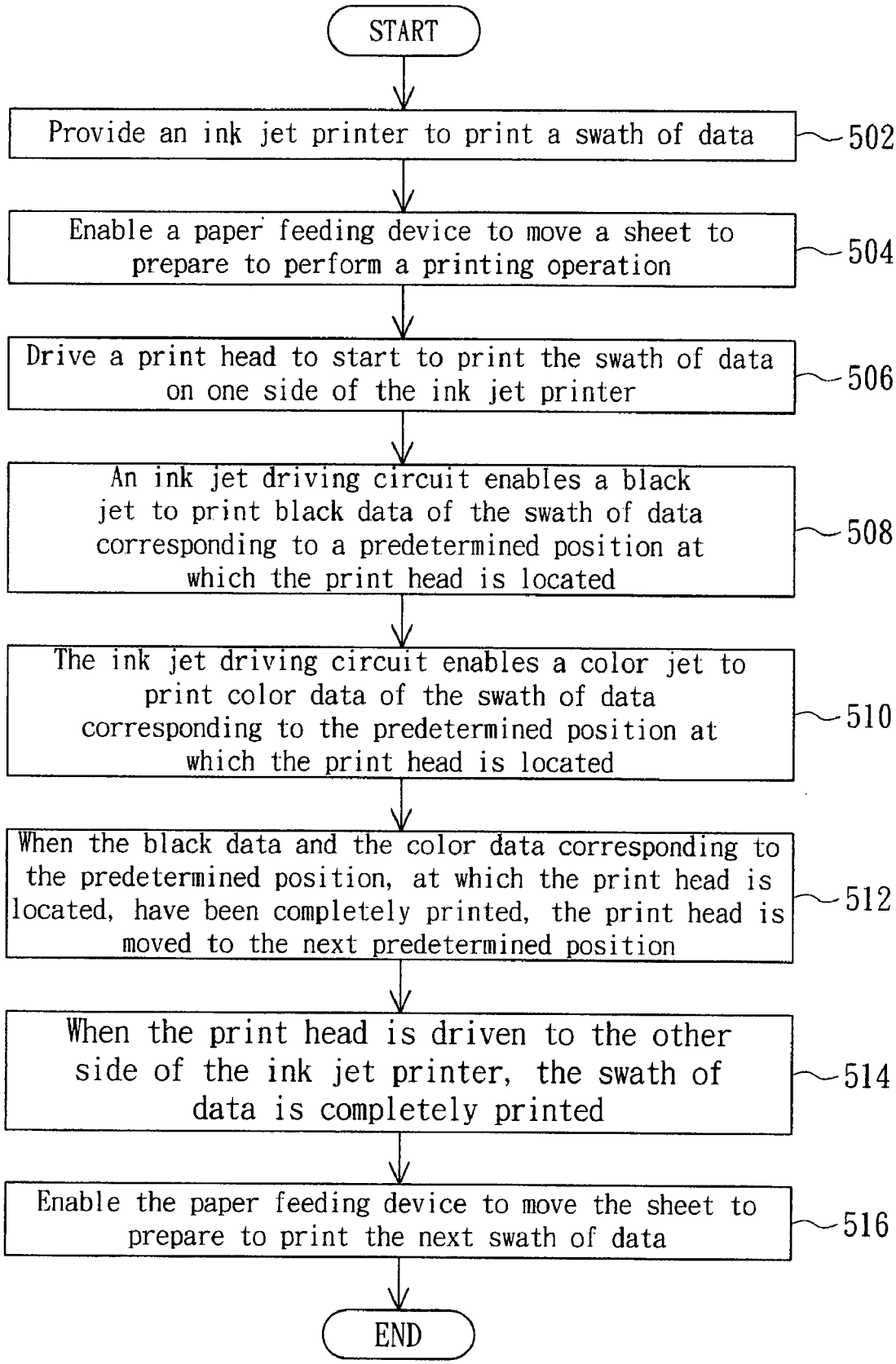
FIG. 5 is a flow chart showing a method for printing data according to a preferred embodiment of the invention.

FIG. 5 is a flow chart showing a method for printing data according to a preferred embodiment of the invention. The method for printing the data is applied to the ink jet printer 100 of FIG. 1, wherein the circuit diagram of the ink jet driving circuit 110 and the print head 112 can be found in FIG. 3.

First, in step 502, the ink jet printer 100 is provided to print a swath of data. Next, in step 504, the paper feeding device 102 is enabled to move a sheet to prepare to perform a printing operation. Then, in step 506, the print head 112 is driven to start to print the swath of data on one side of the ink jet printer 100. Thereafter, in step 508, the ink jet driving circuit 110 enables the black jet 1121 to print the black data of the swath of data corresponding to the predetermined position at which the print head 112 is located. Next, in step 510, the ink jet driving circuit 110 enables the color jet 1122 to print the color data of the swath of data corresponding to the predetermined position at which the print head 112 is located.

Then, in step 512, when the black data and the color data corresponding to the predetermined position, at which the print head 112 is located, have been completely printed, the print head 112 is moved to the next predetermined position. Steps 508 to 512 are alternately performed in order. Next, in step 514, when the print head 112 is driven to the other side of the ink jet printer 100, the swath of data is completely printed. Thereafter, in step 516, the paper feeding device 102 is enabled to move the sheet to prepare to print the next swath of data.

Figure 6:
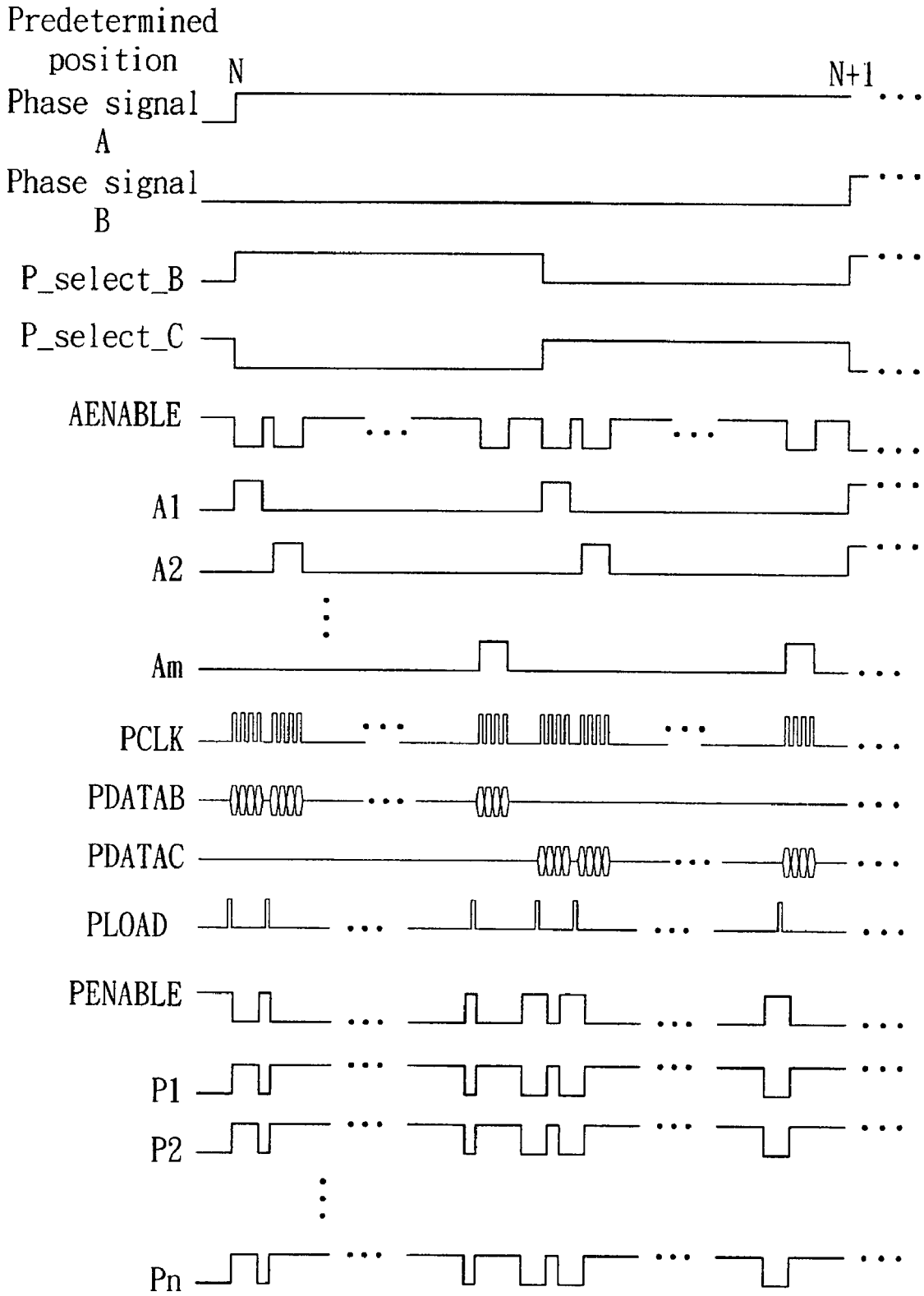
FIG. 6 shows timings for the ink jet driving circuit 110 and the print head 112 in FIG. 3 according to the preferred embodiment of the invention.

FIG. 6 shows timings for the ink jet driving circuit 110 and the print head 112 in FIG. 3 according to the preferred embodiment of the invention. As shown in FIG. 6, the control signal AENABLE is for controlling the A signal, the control signal PENABLE is for controlling the P signal, and the black data signal PDATAB and the color data signal PDATAC respectively transfer the black data and the color data corresponding to the to-be-printed data. The clock signal PCLK sequentially inputs the data to the shift register (not shown) of the ink jet driving circuit 110, and the control signal PLOAD loads the data to the output terminal of the ink jet driving circuit 110 to wait for the control signal PENABLE to enable the P signals. In addition, the first enable signal P_select_B and the second enable signal P_select_C respectively control whether the P signals in the black jet 1121 and the color jet 1122 are enabled.

The signals outputted from the ink jet driving circuit 110 to the print head 112 include the signals A1 to Am, and can control m×n×2 heaters in total. The signals "A" are enabled in the order from A1 to Am, while the P signals can be enabled or disabled simultaneously. As shown in FIG. 6, in the front half portion of the time when the print head 112 is moved from the predetermined position N to the predetermined position N+1, the first enable signal P_select_B enables the P signals in the black jet 1121, and the heaters in the black jet 1121 sequential receive the energy to jet the ink drop (i.e., BA1->BA2-> . . . ->BAm). Then, in the rear half portion of the time when the print head 112 is moved from the predetermined position N to the predetermined position N+1, the second enable signal P_select_C enables the color jet 1122, and the heaters in the color jet 1122 sequential receive the energy to jet the ink drop (i.e., CA1->CA2-> . . . ->CAm).

Consequently, in the period of time when the print head 112 is moved from the predetermined position N to the predetermined position N+1, the ink jet printer 100 has printed the black data and the color data corresponding to the predetermined position N. Thus, the black data and the color data corresponding to the predetermined position N can be performed without the repeated and back-and-forth printing operations being performed in the conventional method for printing the data. So, a lot of time for printing the data is saved, and the speed of printing the data is increased.

Figure 7:
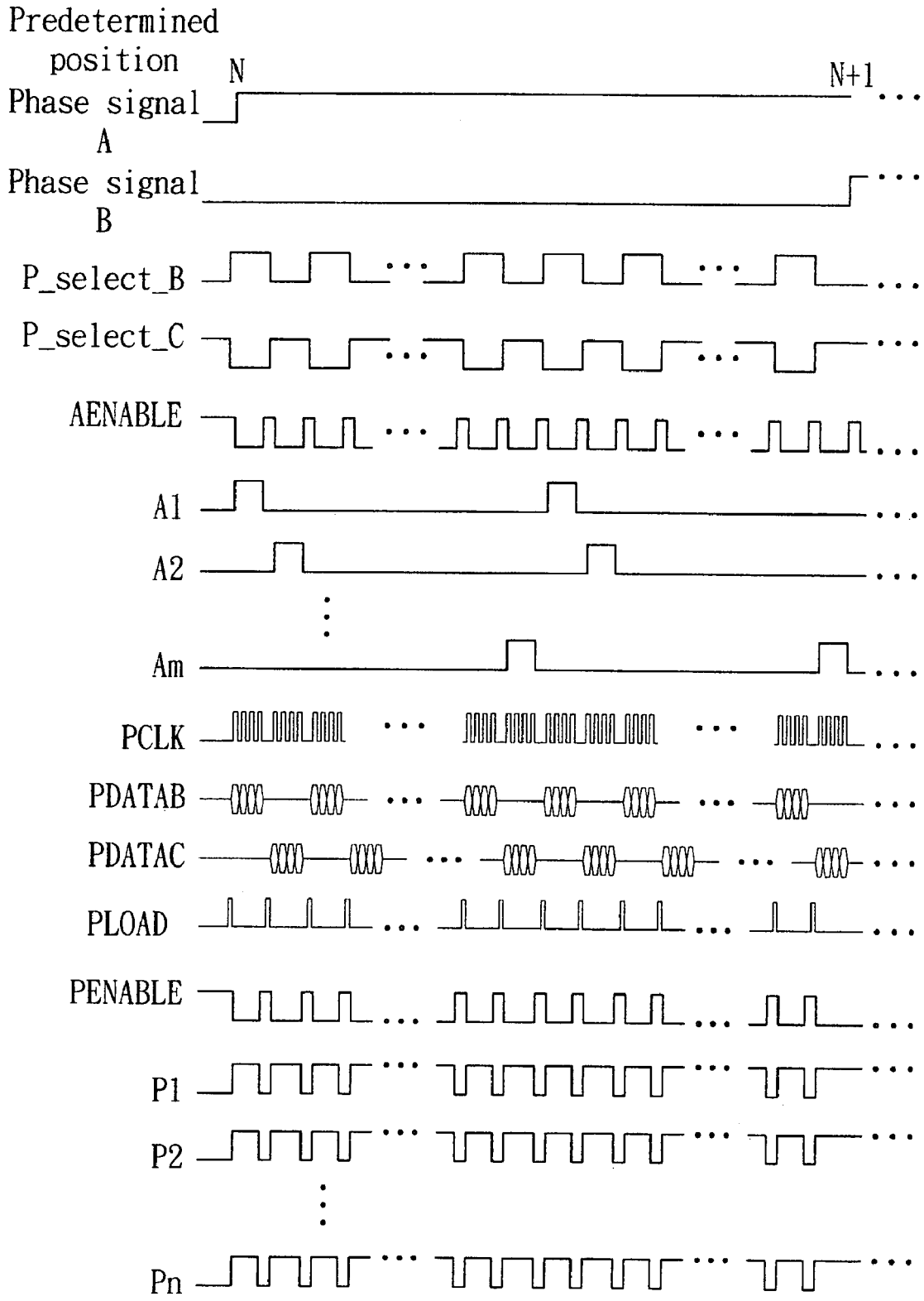
FIG. 7 shows timings for the ink jet driving circuit 110 and the print head 112 in FIG. 3 according to another example of the preferred embodiment of the invention.

FIG. 7 shows timings for the ink jet driving circuit 110 and the print head 112 in FIG. 3 according to another example of the preferred embodiment of the invention. As shown in FIG. 7, the timings of FIG. 7 are different from those of FIG. 6 in that the timings for the first enable signal P_select_B and the second enable signal P_select_C are changed so that the timings of the P signals in the black jet 1121 and the color jet 1122 are also changed.

As shown in FIG. 7, in the period of time when the print head 112 is moved from the predetermined position N to the predetermined position N+1, the first enable signal P_select_B and the second enable signal P_select_C alternately enable the P signals of the black jet 1121 and the color jet 1122 so that the heaters in the black jet 1121 and the color jet 1122 sequential receive the energy to jet the ink drop (i.e., BA1->CA1->BA2->CA2-> . . . ->BAm->CAm). Similarly, the black data and the color data corresponding to the predetermined position N have been printed in the period of time when the print head 112 of the ink jet printer 100 is moved from the predetermined position N to the predetermined position N+1. Thus, a lot of time for printing the data may be saved, and the speed of printing the data may be increased.

According to the method for printing the data in the ink jet printer according to the embodiment of the invention, the order of the timings is controlled to respectively drive the black jet and the color jet of the ink jet printer when a swath of data is being printed. Thus, the black data and the color data at the predetermined position may be respectively printed, and the speed of printing the data can be increased.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for printing data, the method comprising the steps of:

(a) providing an ink jet printer to print a swath of data, the ink jet printer having a print head, an ink jet driving circuit, and a phase encoder, the print head having a black jet and a color jet, the phase encoder being used for recording a plurality of predetermined positions respectively corresponding to one of the pieces of black data and one of the pieces of color data;

(b) driving the print head to start to print the swath of data on one side of the ink jet printer;

(c) alternately triggering the black jet and the color jet to print corresponding pieces of black data and corresponding pieces of color data in the swath of data, the step (c) comprising:

(c1) enabling, by the ink jet driving circuit, the black jet to print the corresponding piece of black data in the swath of data; and (c2) enabling, by the ink jet driving circuit, the color jet to print the corresponding piece of color data in the swath of data; and (d) when the print head is driven to the other side of the ink jet printer, the swath of data is completely printed, wherein the steps (a) to (d) are performed in order;

wherein the steps (c1) and (c2) are performed alternately;

wherein after the steps (c1) and (c2) are performed once, the piece of black data and the piece of color data corresponding to the predetermined position at which the print head is located have been completely printed.

2. The method according to claim 1 further comprising the step of:

moving the print head to a next predetermined position to prepare to print the piece of black data and the piece of color data corresponding to the next predetermined position after the piece of black data and the piece of color data corresponding to the predetermined position, at which the print head is located, have been completely printed.

3. The method according to claim 1, wherein the swath of data is transmitted from a host to the ink jet printer.

4. The method according to claim 1, wherein the pieces of color data are composed of cyan data, magenta data and yellow data.

5. The method according to claim 1, wherein the ink jet printer further comprises a paper feeding device, and the step (a) further comprises:

(a1) providing the ink jet printer to print the swath of data; and (a2) moving, by the paper feeding device, a sheet to prepare to perform a printing operation.

6. The method according to claim 5, further comprising the step of:

(e) moving, by the paper feeding device, the sheet to prepare to print a next swath of data after the swath of data is completely printed, wherein, the step (e) is performed after the step (d).

7. An ink jet printer for printing a swath of data, the swath of data comprising a plural pieces of black data and a plural pieces of color data, the ink jet printer comprising:

a print head having a black jet and a color jet;

a phase encoder for recording a plurality of predetermined positions each corresponding to one of the pieces of black data and one of the pieces of color data; and an ink jet driving circuit for outputting a first enable signal and a second enable signal, wherein the black jet prints the corresponding piece of black data in the swath of data when the first enable signal is enabled, the color jet prints the corresponding piece of color data in the swath of data when the second enable signal is enabled, and the first enable signal and the second enable signal are alternately enabled, wherein when the first enable signal and the second enable signal are enabled once, the piece of black data and the piece of color data corresponding to the predetermined position, at which the print head is located, are completely printed.

8. The printer according to claim 7, wherein after the piece of black data and the piece of color data corresponding to the predetermined position, at which the print head is located, are completely printed, the print head is moved to a next predetermined position to prepare to print the piece of black data and the piece of color data corresponding to the next predetermined position.

9. The printer according to claim 7, further comprising a paper feeding device for moving a sheet to prepare to perform a printing operation, and further moving the sheet to prepare to print a next swath of data after the swath of data is completed printed.

10. The printer according to claim 7, wherein the swath of data is transmitted from a host to the ink jet printer.

11. The printer according to claim 7, wherein the pieces of color data are composed of cyan data, magenta data and yellow data.

* * * * *